US008143506B2

(12) United States Patent
Clark et al.

(10) Patent No.: US 8,143,506 B2
(45) Date of Patent: Mar. 27, 2012

(54) HAMMER ASSEMBLY FOR GRAND PIANO

(76) Inventors: Bruce E. Clark, Nottingham, NH (US); Kevin Burke, Haverhill, MA (US); Kirk Burgett, Sacramento, CA (US)

( * ) Notice: Subject to any disclaimer, the term of this patent is extended or adjusted under 35 U.S.C. 154(b) by 455 days.

(21) Appl. No.: 12/417,441

(22) Filed: Apr. 2, 2009

(65) Prior Publication Data

US 2009/0235804 A1 Sep. 24, 2009

Related U.S. Application Data

(63) Continuation-in-part of application No. 12/013,330, filed on Jan. 11, 2008, now Pat. No. 7,687,692.

(51) Int. Cl.
*G10C 3/18* (2006.01)

(52) U.S. Cl. ..... 84/236

(58) Field of Classification Search ..... 84/13, 23, 84/26, 24, 27, 33, 66–69, 71, 173, 174, 216–221, 84/236–245

See application file for complete search history.

(56) References Cited

U.S. PATENT DOCUMENTS

2005/0045016 A1* 3/2005 Yoshisue ..... 84/251

* cited by examiner

*Primary Examiner* — Kimberly Lockett
(74) *Attorney, Agent, or Firm* — Craig A. Simmermon

(57) ABSTRACT

A hammer assembly for a grand piano comprising: a hammer, a hammer shank, a tubular lever interface, and a moveable knuckle. A grand piano tubular lever interface comprises: a deep socket; a set of two hinge pin attachment holes; a void area; and a moveable knuckle visual location system. A moveable knuckle comprises: a spline; a resilient core; a synthetic buckskin wear surface, and a moveable knuckle visual location system. Novel hammer assembly allows for a direct lever relationship between hammer shank and knuckle without requirement of a forked end hammer shank with knuckle slot. Best mode spline comprises: an upright rectangular portion and a wide base portion, wherein wide base portion includes an intricate shape. Intricate shape comprises: at least one recess area and at least one protrusion area. The inverse of intricate shape is included on the bottom of the tubular lever interface. Moveable knuckle visual location system further comprises at least one pointer located on the moveable knuckle which fits snuggly into one of several notches on the tubular lever interface. Moveable knuckle can be visually located onto tubular lever interface at any one of multiple distinct locations along a range that runs parallel to the length of the hammer shank and the length of tubular lever interface. The moveable knuckle visual location system allows for custom configuration of a specifically dimensioned hammer assembly with custom "tubular lever interface center-to center" dimension to refurbish any brand of grand piano from one stock-set of hammer assembly components.

15 Claims, 9 Drawing Sheets

HAMMER ASSEMBLY FOR GRAND PIANO

CROSS-REFERENCE TO RELATED APPLICATIONS

The instant application is a continuation-in-part of U.S. application Ser. No. 12/013,330 entitled "Hammer Shank and Shank Butt for Piano", filed on Jan. 11, 2008 now U.S. Pat. No. 7,687,692. Claim 1 pertains to matter filed with the parent application. All additional claims claim the benefit of the instant application.

BACKGROUND OF THE INVENTION (1) Field of the Invention

This invention relates to key operated percussion devices such as pianos and, more specifically, to the hammer assemblies of such devices. A hammer assembly according to this invention comprises: a hammer 40; a hammer shank 30; a tubular lever interface 20; and a moveable knuckle 240.

(2) Description of Prior Art

A piano produces sound as a result of a complicated mechanical chain reaction which starts with the pianist depressing a piano key which in turn actuates a piano action 15 associated with a key 10 which in turn rotates a hammer assembly associated with the piano action which in turn strikes a piano string or strings 35 to make sound.

More specifically, a depressed key 10 gives rise to motion of the damper head assembly (not shown), separating the damper head from the associated set of strings 35, setting the strings ready to accept vibrations. The piano strings 35 are located just above the hammer. The depressed key 10 also actuates the piano action 15 thereby pushing or "throwing" the associated hammer 40 and hammer shank 30 into the associated set of strings or string 35. The hammer 40 strikes the strings, generating a piano tone. The piano action 15 then receives or "catches" the hammer 40 and hammer shank 30 after it strikes the strings 35 and rebounds back against the action 15. When the pianist releases the depressed key 10, the key 10 returns to the rest position, and permits the damper head assembly to return contact with the vibrating strings 35. The vibrations are absorbed by the damper head assembly, and the piano tone is terminated.

With a grand piano 45, a certain amount of kinetic energy is required when depressing a key 10 in order to move a hammer 40 as imparted by the piano action 15 to the hammer shank (20 and 30). When a key 10 is depressed, the repetition base 70 is pushed up pivotally about the repetition flange 90. The jack 50 is simultaneously moved upward pivotally about point 100 in the clockwise direction and pivotally about repetition flange 90 in the counterclockwise direction, resulting in a general upward motion. The jack 50 lifts the knuckle 80, which also moves upward from double pivot motion, this time about the repetition flange 90 and point 110. The jack 50 raises the knuckle 80 along with the hammer shank (20 and 30) thereby lifting the hammer 40 upwards towards the piano strings 35. The knuckle 80 also slides along the guide surface of the balancier 60. These both cause the hammer 40 to move upward by rotation about point 105 towards the set of horizontally stretched strings or string 35 associated with that key 10. The hammer 40 moves with "free rotation" powered by the knuckle 80 driven by the jack 50. The hammer shank 30 is further rotated and disconnects from the balancier 60 in order for the hammer 40 to strike the strings 35. There is one hammer assembly and one piano action for each of the eighty-eight keys of a grand piano.

At this point, on both grand pianos and upright pianos, conventional wood hammer shanks 30 bend somewhat before whipping around to strike the strings 35. This phenomenon can be verified by simple high speed photography of hammer motion resulting from practically every instance of piano playing. The more virtuosic the particular piano piece played, the greater the bending or deflection of the hammer shanks 30. This is because virtuosic piano pieces require greater key depression strength with faster key depression repetitions, which results in more forceful and more frequent hammer assembly rotations. As with all deflection motion, the greater the force applied on the body, the greater the deflection.

Since the energy absorbed by a bending of hammer shank 30 does not directly translate into the production of music, it is wasted energy or energy loss of the system. Thus, more key depression energy is required in order to produce music as a result of the bending of a hammer shank 30. Therefore, the elimination of hammer shank 30 deflection lowers the threshold energy key depression requirement for the creation of sound. Hence the elimination of hammer shank 30 deflection results in a more responsive piano that requires less effort to play.

Additionally, the weight of the hammer assembly affects the responsiveness of the piano action. The leverage of most grand piano actions is about 5-7 to one at the hammer assembly. Thus, a slight increase in the hammer assembly weight or shank weight is quickly reflected in the key down weight. I.e., an increase in weight of shank 30 results in an exponential increase in the energy requirement for key depression. Likewise, a decrease in shank weight results in an exponential decrease in key depression energy. Thus, a lighter hammer assembly results in a more responsive piano that requires less effort to play.

The grand piano hammer assembly of prior art comprises a one-piece hammer shank 30 that has a cylindrical end and a forked end 88. The Forked end 88 attaches directly to a shank flange 95 by a hinge pin 93. The shank flange 95 is attached to the shank rail on the piano (not depicted). Hammer shank forked end 88 needs to be wider than the shank portion because it is at this location where the knuckle 80 is attached to the member 30. Prior art knuckles consist of a spline 82, resilient inner core cushion 84, and synthetic buckskin wear surface 86. The forked end 88 of the shank 30 further comprises a slot 89 into which the knuckle spline 82 is secured, thereby connecting the knuckle 80 to the hammer shank 30 to form a sub-assembly. The forked end 88 needs to be wide at this location because the slot 89 weakens this end. Because the slot weakens the hammer shank, more deflection and bending of the shank occurs than would happen if the slot 89 were not present. As stated above, the hammer assembly must withstand deflection forces caused by the acceleration of the hammer 40 towards the string(s) 35. The more deflection, the less efficient the hammer assembly is at accelerating the hammer 40 towards the string(s) 35. Also, as a result of being wider, the forked end 88 is heavier, which also greatly reduces efficiency of this motion.

The hammer 40 is attached to the sub-assembly at the cylindrical end or other end of the hammer shank 30. The cylindrical end of the shank 30 is inserted into a hole on the hammer 40. Both knuckle and hammer attachments are typically achieved by gluing means. The shank 30 is made of wood throughout, typically hornbeam or maple wood. The prior art does not consist of separate tubular lever interface 20 and hammer shank 30 components.

Prior art hammer shanks 30 come in one standard diameter or cross sectional area that can be thinned to reduce mass. The reduced mass is particularly required in the treble section because of the need to make the hammer rebound more quickly from the string. Prior art hammer shanks 30 are thinned, in two or three increments, as the pitch of the string or strings 35 associated with the particular hammer shank increases. For manufacturing efficiency, this thinning is not continuous but rather is stepped by three separate groups—"thin", "medium", and "thick". "Thick" hammer shanks 30 are not trimmed at all and are used on the bass end of the piano. The deflection referenced above occurs in the hammer shank (20 and 30).

Relative to more modern materials, such as composites or plastics, wood is an inefficient raw material from which to manufacture piano action components. Wood action pieces must be drilled to produce the holes required for pivotal connections and assembly with other action components. The hole-drilling process is a laborious and costly process as compared to the production of molded piano action pieces with holes accurately formed therein during the initial molding process. Also, the production of any finished wood piece necessarily involves relatively large quantities of wasted material in the form of saw dust, which is inefficient and wasteful.

Wood is hydroscopic, i.e. wood swells, shrinks, or twists as its moisture content changes in response to the environment. This can cause binding in the action. Additionally, after repeated occurrences, this causes compression of the wood leading to failure of the piano action component thus requiring excessive in field service. For instance, wood flanges often crack due to expansion from a rise in moisture content, as the screw crushes the wood in the flange where it is fastened to the rail.

Moreover, wood has different strengths in different directions, complicating manufacturing processes, also resulting in reduced manufacturing efficiencies. Additionally, wood has inferior rigidity and strength as compared to modern composites and plastics. In particular, rigidity and strength is of the utmost importance to the hammer assembly portion of the complicated mechanical chain reaction of a piano.

Finally, the lifespan of wood piano action components is limited as compared to that of other materials such as composites or plastics because wood over time deteriorates becoming weak and unserviceable. On the other hand, composite piano action components would have several times the life span of that of their wood counterparts and thus result in more efficient manufacture and maintenance of a piano.

SUMMARY OF THE INVENTION

It is an object of this invention to provide a new hammer assembly for a piano that requires less initial energy from the pianist's fingers in order to deliver the same sound of that generated by currently available hammer assemblies. This can be accomplished by the elimination or substantial reduction of hammer assembly deflection, without increasing the weight of the hammer assembly. Thus, it is an object of this invention to yield an improved hammer assembly with substantially increased stiffness or rigidity without additional mass, thereby effectively providing a more responsive keyboard that requires less effort to play.

It is also an object to provide a hammer assembly that can be retrofitted into any existing piano. This object includes the ability to retrofit or refurbish existing grand pianos from any manufacturer, such as Mason & Hamlin, Steinway, Yamaha, Kawai, and many others, from only one stock-set of hammer assembly components held by the piano technician. Typically, each brand of grand piano requires a unique set of hammer assemblies with specific dimensions and thus parts for one piano would not normally interchange with another. This invention allows one set of parts to be configured so as to fit into the vast majority of grand pianos. These can be provided either as pre-configured stock sets or the technician can create a custom configuration that will work for his own situation. To this end, a number of flanges and knuckle sizes are provided.

Additionally, it is an object of this invention to yield a hammer assembly with the collateral benefits of increased efficiency of manufacture and maintenance over those of their corresponding wood counterparts. Thus, it is an object of this invention to yield a more rigid hammer assembly without additional mass with the additional benefits of increased efficiency of manufacture and maintenance.

Figure 1:
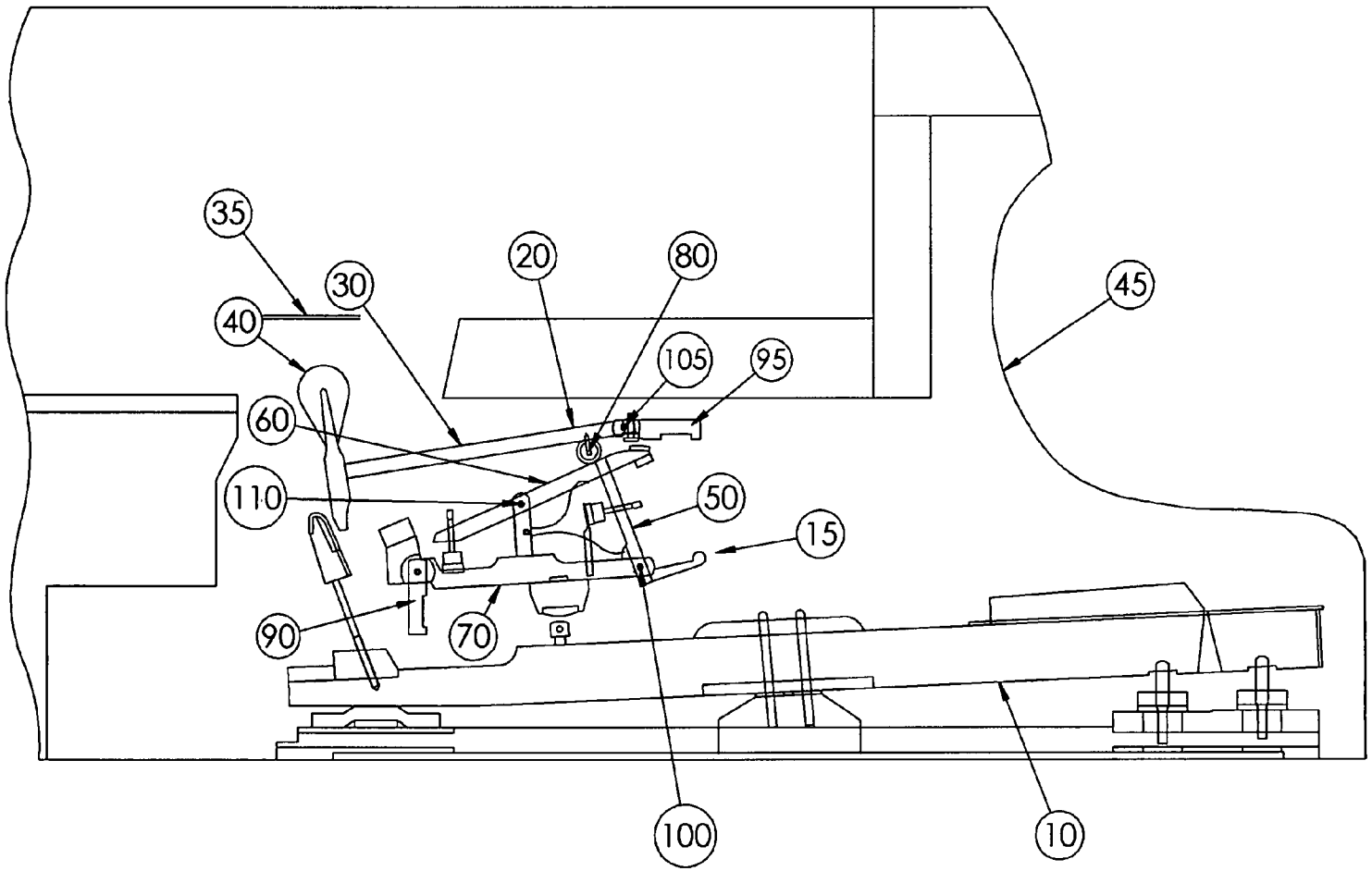
Prior Art Fig. 1
FIG. 1 is a cross sectional view of a generic grand piano.
Figure 2:
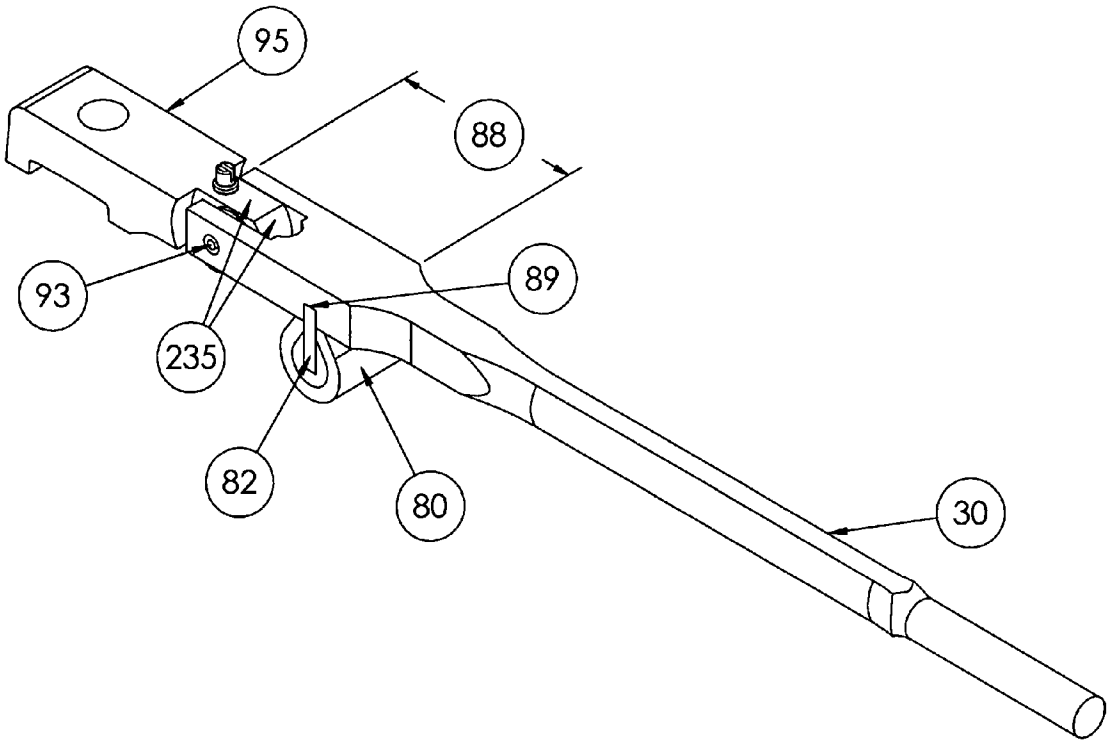
Prior Art Fig. 2
FIG. 2 is a perspective view of a prior art grand piano hammer shank, with attached prior art knuckle, that is assembled to a shank flange by a hinge pin.

All drawings in this application are in landscape orientation.

DEFINITION LIST

| Term | Definition |
|---|---|
| 10 | Piano Key for Grand Piano |
| 15 | Piano Action for Grand Piano |
| 20 | Tubular Lever Interface (TLI) for Grand Piano |
| 30 | Hammer Shank |
| 35 | Piano Strings |
| 40 | Hammer |
| 45 | Grand Piano |
| 50 | Grand Piano Jack |
| 60 | Grand Piano Balancier |
| 70 | Grand Piano Repetition Base (Prior Art) |
| 80 | Grand Piano Knuckle (Prior Art) |
| 82 | Wood Spline on Knuckle |
| 84 | Resilient Core Cushion of Knuckle |
| 86 | Synthetic Buckskin Wear Surface of Knuckle |
| 88 | Fork End of Prior Art Shank Flange |
| 89 | Knuckle Slot on Prior Art Hammer Shank |

-continued

| Term | Definition |
|---|---|
| 90 | Grand Piano Repetition Flange |
| 93 | Shank Flange Hinge Pin |
| 95 | Grand Piano Shank Flange |
| 100 | Grand Piano Jack Pivot Point |
| 105 | Grand Piano Hammer Center of Rotation/Pivot Point |
| 110 | Grand Piano Balancier Pivot Point |
| 150 | Tubular Lever Interface Center-to-Center Distance |
| 160 | Tubular Lever Interface Knuckle Protrusion |
| 170 | Knuckle Diameter |
| 175 | No knuckle slot here to weaken shank assembly |
| 180 | Tubular Lever Interface Lower Lever Arm |
| 185 | Hammer Shank Center of Rotation |
| 190 | Moveable Knuckle Visual Location System |
| 191 | Half round shape |
| 192 | Notches on TLI to Locate Moveable Knuckle on TLI |
| 194 | Pointers on Moveable Knuckle to Locate It on TLI |
| 196 | Intricate Shape on Bottom of TLI |
| 197 | Protrusion area on 196 |
| 198 | Graduation Marks on Side of Tubular Lever Interface |
| 199 | Recess area on 196 |
| 200 | Deep Socket on TBI for Connection to Hammer Shank |
| 203 | Socket 200 extends beyond Moveable Knuckle location on TLI |
| 207 | Anchor Force from Shank Flange Hinge Pin |
| 208 | Upward Force from Piano Action |
| 209 | Rotational Motion of Hammer Assembly |
| 210 | Hollow Center of Best Mode Hammer Shank |
| 220 | Hinge Pin Holes on Tubular Lever Interface |
| 230 | Void Area on Tubular Lever Interface |
| 235 | Hinge Section of Shank Flange |
| 239 | Upright Rectangular Member of Spline |
| 240 | Moveable Knuckle |
| 241 | Spline of Moveable Knuckle |
| 242 | Resilient Cylindrical Core Cushion of Moveable Knuckle |
| 243 | Synthetic Buckskin Wear Surface of Moveable Knuckle |
| 244 | Wide Base Member of Spline |
| 245 | Intricate Shape on Bottom of Moveable Knuckle |
| 246 | Knuckle Center-Line |
| 247 | Protrusion area on 245 |
| 248 | Location Mark on Side of Moveable Knuckle |
| 249 | Recess area on 245 |

DETAILED DESCRIPTION

A hammer assembly of this invention comprises: a hammer 40; a hammer shank 30; a tubular lever interface 20; and a moveable knuckle 240. This invention includes novel hammer shanks 30, novel tubular lever interfaces 20, and novel moveable knuckles 240, where an assembly of such can be attached to prior art hammers 40 which are typically made of hornbeam wood and felt. The hammer assemblies of this invention can be installed into any grand piano of any brand.

All hammer shanks 30 of this invention are essentially cylindrically shaped made from composite or plastic material with an overall outer diameter range of 1-8 mm. Such hammer shanks 30 can be manufactured with less weight and more rigidity than their wood counterparts. This is particularly so when the hammer shank 30 is made of hollow form because hollow parts naturally weigh less than non-hollow parts. Thus, best mode hammer shank 30 of this invention is hollow in the center as depicted at 210. The hollow cross section of the shank 30 does not have to be round, but typically is so. Likewise, the outer cross section of the shank 30 does not have to be round, but typically is so.

Hollow hammer shanks are typically most efficiently produced by an extrusion or pultrusion process. The shape of shanks 30, which is essentially cylindrical with a constant cross-section, lends itself to efficient manufacture by extrusion or pultrusion as opposed to molding. The "one stock set" object of the invention also lends itself to the use of extrusions and pultrusions because these articles of manufacture can be sourced in lengths longer than that of a typical hammer shank length. Typically, pultrusion articles have higher rigidity than extruded articles because the fibers used with pultrusion are continuous and typically thicker and stronger. Thus, pultrusion hammer shanks 30 are the best mode. Standard lengths can be cut to the specific length required for the particular brand of piano being refurbished and assembled to the rest of the hammer assembly.

The rigidity of plastic articles can be increased with filler additives. There are many filler additives such as glass fiber, carbon fiber, ceramics, or Kevlar fiber, respectively from least to most costly. In the case of pultruded parts, carbon fillers are considered best mode because: a) carbon fibers tend to tear apart less as compared to glass fibers and b) are less costly than ceramics and Kevlar fibers. Carbon fiber pultrusion hammer shanks 30 have the required rigidity to withstand virtuosic piano playing with minimal bending, where such ratios between rigidity and weight could not be attained by molded articles, which would be more costly to produce anyway.

More than one diameter hammer shank 30 is used in a typical piano. Thus, the invention includes separately designed tubular lever interfaces 20, each with an appropriated sized deep socket 200, to accept the various hammer shank 30 diameters in the public domain and those incorporated in this invention. Diameters have been chosen that provide the best balance between stiffness and mass.

Figure 4:
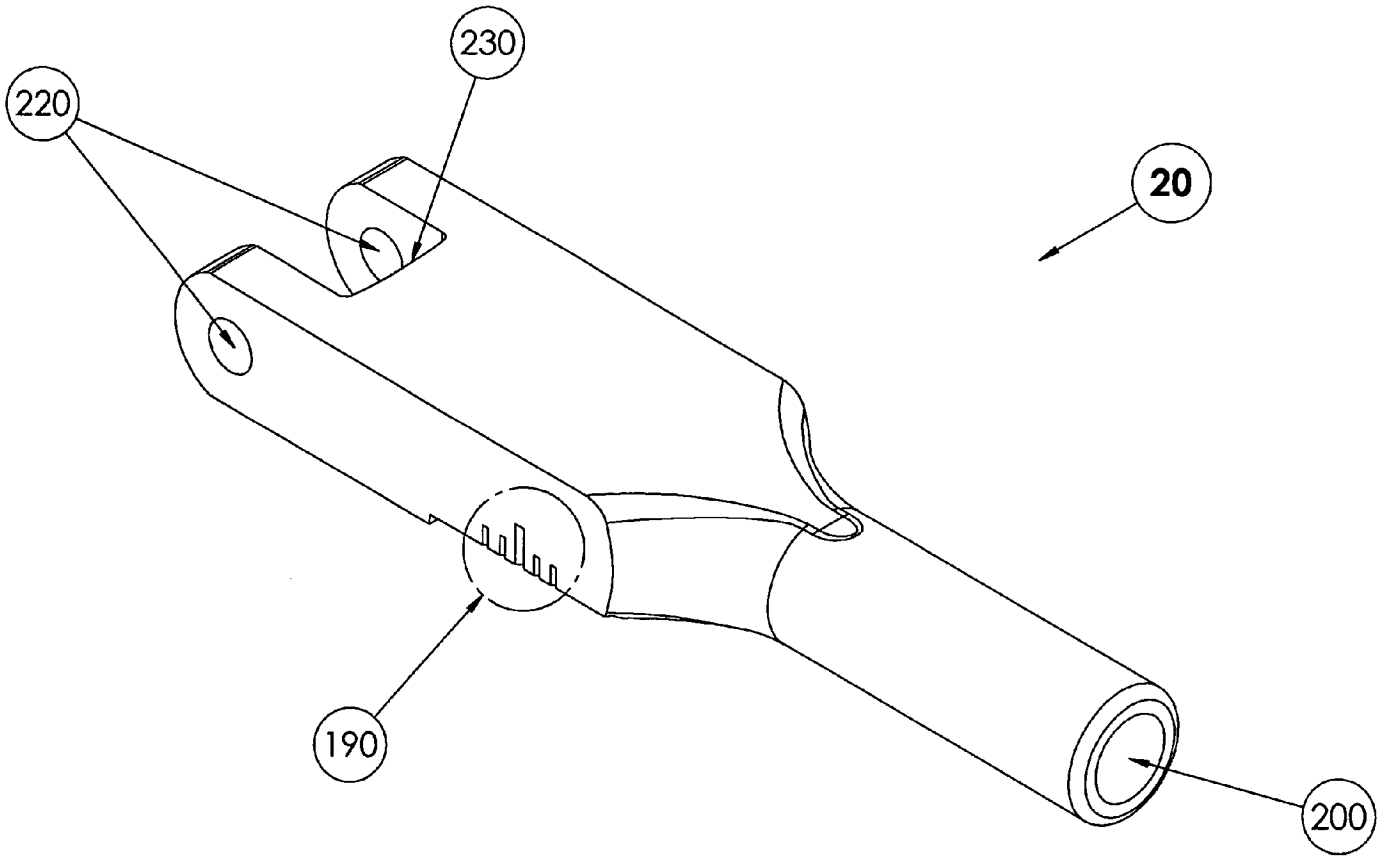
FIG. 4 is a perspective view of a tubular lever interface.

A grand piano tubular lever interface 20 comprises: a deep socket 200; a set of two hinge pin attachment holes 220; a void area 230; and a moveable knuckle visual location system 190. See FIG. 4. A tubular lever interface 20 is attached to a shank flange 95 with a shank flange hinge pin 93. The hinge pin 93 has length that is essentially the same as the widest portion of the tubular lever interface 20. To connect these members, the hinge pin 93 is inserted through both attachment holes 220 and the pin hole on the flange, thereby creating a pivotal connect between these members, thereby creating "a hinge" arrangement between said members. Void area 230 is necessary to allow clearance during rotation of tubular lever interface 20 around shank flange 95. Thus, 230 is the female section of first hinge member 20, while 235 is the male section of second hinge member 95 to form said hinge arrangement.

A grand piano tubular lever interface 20 is attached to one end of the hammer shank 30 at deep socket portion 200 of tubular lever interface 20. After the shank section 30 has been cut to size, it is affixed into deep socket 200 typically by glue or other similar means of connection, thereby forming a subassembly. The moveable knuckle 240 is then attached to the tubular lever interface 20 at the proper location using a moveable knuckle visual location system 190. Further, a grand piano hammer 40 is connected to the other end of said hammer shank 30 with glue or other similar means, thereby forming said hammer assembly. Normal woodworking glues can be used to attach the hammer in place by roughing the gluing surface of the shank before gluing.

Figure 3:
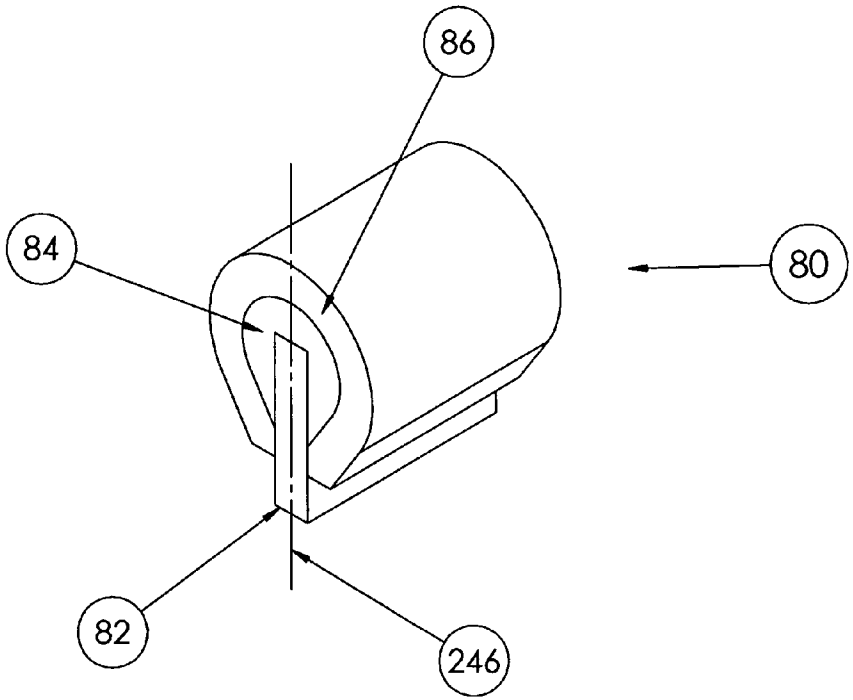
Prior Art Fig. 3
FIG. 3 is a perspective view of a prior art knuckle for grand piano.
Figure 6:
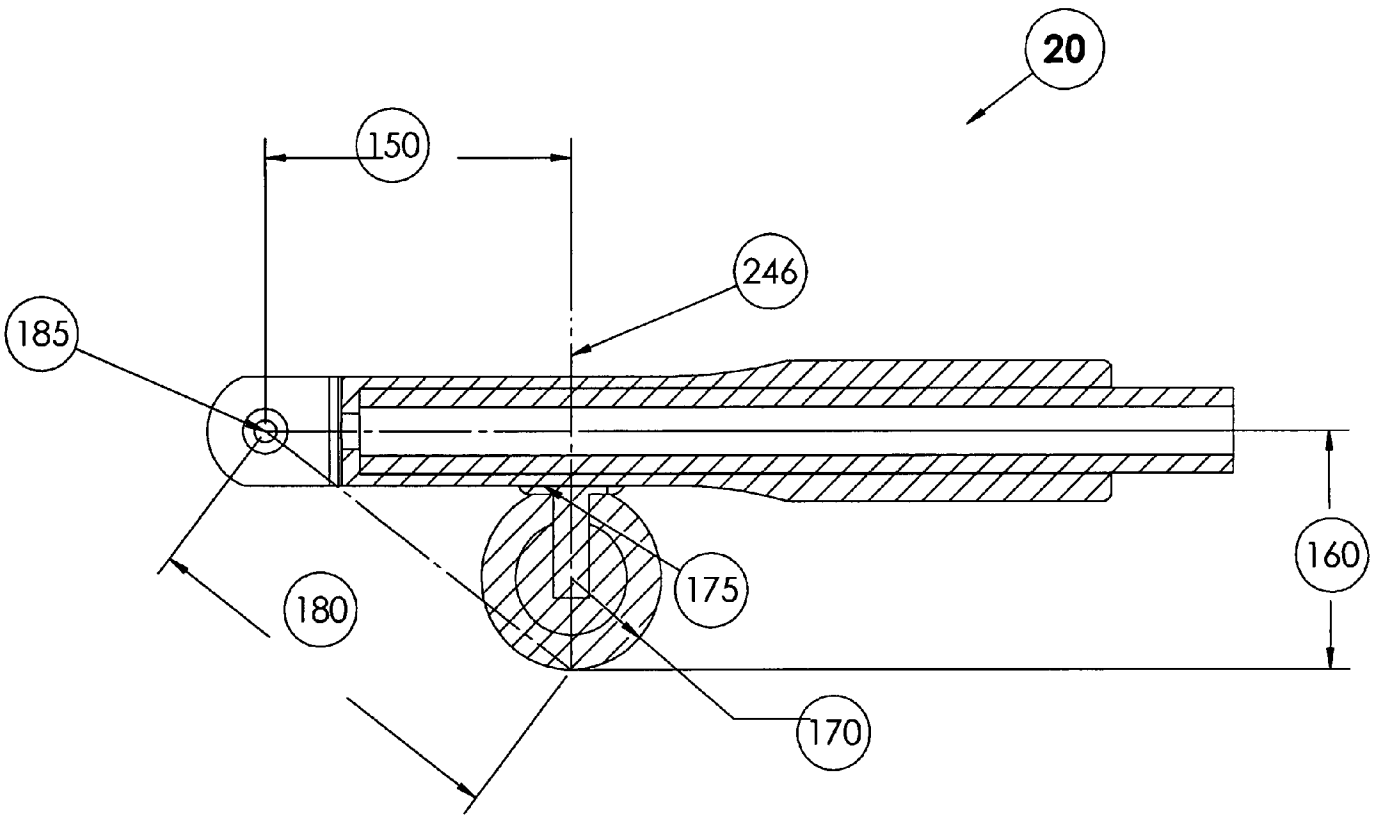
FIG. 6 is a cross sectional view of the "lever arrangement" depicting critical dimensions required for proper refurbishment of existing pianos.

The moveable knuckle 240 transmits energy from the upward moving jack 50 to the tubular lever interface 20 and the hammer shank 30. As the jack 50 moves upwards as the result of a keystroke, the moveable knuckle 240 also moves upwards, thereby pushing the tubular lever interface 20 upwards, which in turn pushes the hammer shank 30 upwards. The leverage applied to the hammer assembly of a grand piano may be adjusted according to certain criteria of the tubular lever interface 20. These criteria are tubular lever interface center-to-center 150, tubular lever interface protrusion 160, knuckle diameter 170, and tubular lever interface lower lever arm 180. See FIG. 6. Criteria 150 is defined as the distance between the hammer shank center-of-rotation 185 (which is same location of 105) and the knuckle center-line 246. Knuckle center-line 246 is defined as the center-line of the member, as viewed from the side. See FIG. 3. Tubular lever interface protrusion 160 is varied by adjusting the knuckle diameter 170. Together, these two criteria determine the tubular lever interface lower lever arm 180. A particular brand of grand piano likely requires these criteria be specific and different from those of other brands of grand piano. Typically, different brands require a specific tubular lever interface center-to center dimension 150 and a specific tubular lever interface protrusion dimension 160.

A moveable knuckle 240 comprises: a spline 241; a resilient cylindrical core 242; a synthetic buckskin wear surface 243, and a moveable knuckle visual location system 190. The spline 241, the cylindrical core 242, and the synthetic buckskin wear surface 243 must be sized for each desired protrusion dimension. For a given piano one need only select the proper option. Thus, it may be required to stock more than one size moveable knuckle 240 to fulfill the full range of the retrofitablity object. Said moveable knuckle visual location system 190 can be incorporated into the spline member 241, where both are a part of an integral member. Best mode spline 241 comprises: an upright rectangular portion 239 and a wide base portion 244. Resilient cylindrical core 242 and wear surface 243 are affixed primarily to upright rectangular portion 239. Wide base portion 244 includes an intricate shape 245 on its bottom surface. Intricate shape 245 comprises: at least one recess area 249 and at least one protrusion area 247. The inverse of intricate shape 245 is included on the bottom of the tubular lever interface 20 at 196. Thus, inverse intricate shape 196 comprises: at least one protrusion area 197 (to match the recess 249 on the moveable knuckle) and at least one recess 199 (to match the protrusion 247 on the moveable knuckle). These alternate inverse shapes fit snugly together when pressed together and have proper clearance between shapes for glue or similar connection means. The "alternate inverse shape" design yields surfaces that are very conducive to affixing to each other by glue or similar connection means to yield a strong and rigid permanent connection. Despite both 196 and 245 being labeled as "bottom" surfaces, it is these "bottom" surfaces which marry together to yield a subassembly. As oriented in an assembled piano action 15, the bottom of moveable knuckle is actually located on top of the knuckle.

Moveable knuckle visual location system 190 further eliminates the need for the knuckle slot 89 on the hammer assembly which in turn allows for a weight reduction in the hammer assembly. There is no knuckle slot at 175. As stated above, knuckle slot 89 significantly reduces the strength of and adds weight to the hammer assembly. With the moveable knuckle location system of this invention, no slot 89 is required, thus hammer assembly components may be made lighter and more rigid.

Figure 5:
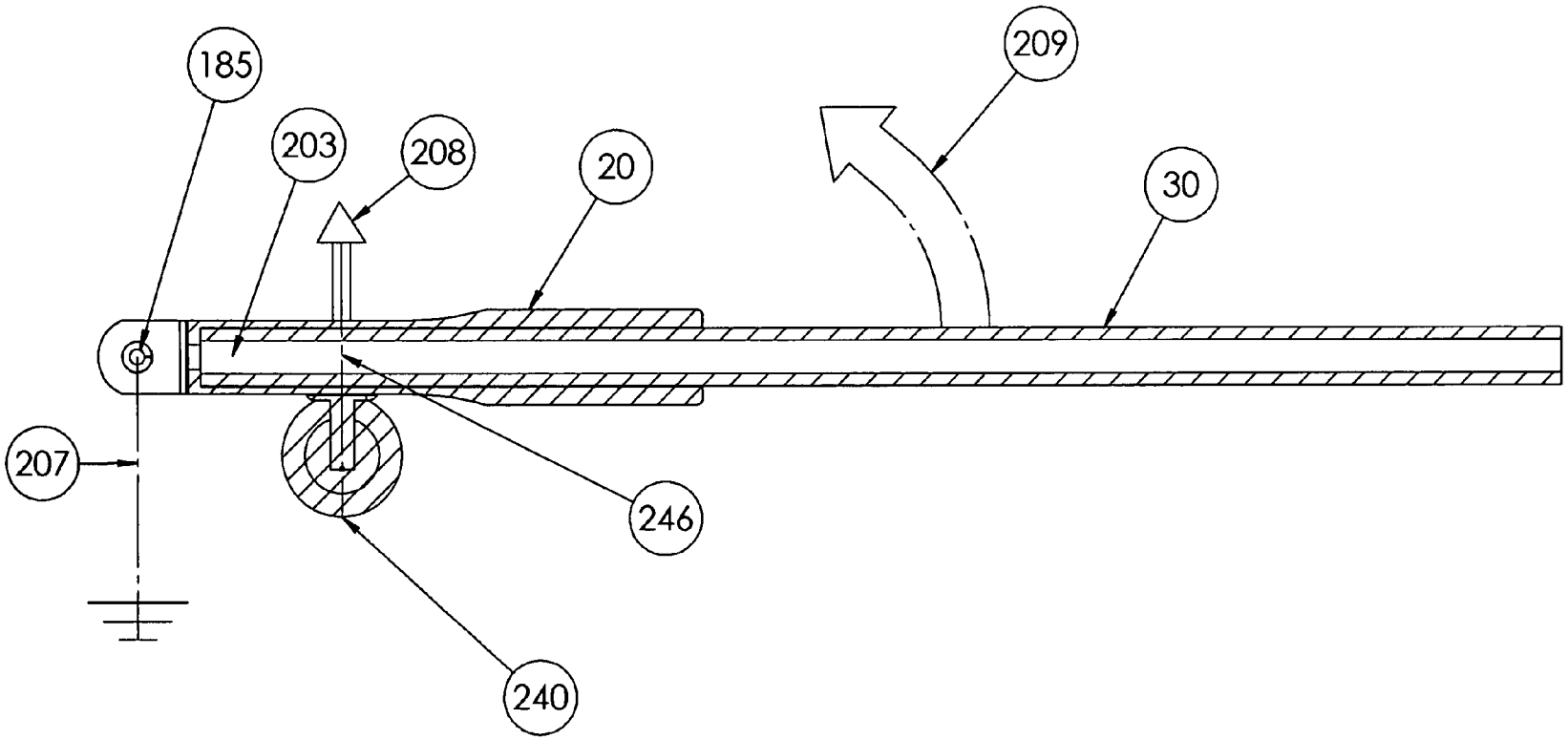
FIG. 5 is a cross sectional view of a tubular lever interface with attached moveable knuckle and attached hammer shank demonstrating "a lever" assembly.

Additionally, this design allows for deep socket 200 to exist in tubular lever interface 20. If slot 89 were required, it would interfere with deep socket 200 and hammer shank 30, requiring a gap in these members, which would significantly reduce their rigidity to the point of failure. Thus, both slot 89 and deep socket 200 could not be present at the same time. Deep socket 200 is advantageous for two reasons. First, the deep socket 200 essentially yields a hollow tubular lever interface 20 which in turn yields a lighter hammer assembly. Secondly, deep socket 200 provides a strong lever arrangement between the knuckle 240 and the shank 30. See FIG. 5. Without 200, during the course of a piano action cycle, knuckle 240 would push upwards on the tubular lever interface 20. This force, thus, requires that member 20 be strong and rigid to resist deflection, which in turn requires additional weight of member 20. Whereas shank member 30, being a hollow pultrusion of composite carbon fiber material, as stated above, is better equipped to handle such upward force without deflection at a better "per weight" basis than member 20 which is a molded article from practical and efficient means. With deep socket 200, shank 30 can be inserted all the way into tubular lever interface 20, beyond knuckle center-line at 246, allowing direct force transfer from knuckle 240 to shank 30, creating a lever relationship between said members. Such lever arrangement results from upward force 208 (from piano action) upon hammer assembly which is secured by fulcrum 185, at hammer shank center of rotation 105, where hammer assembly is anchored steady to hinge pin by force 207, thus creating the lever arrangement, which results in hammer assembly motion 209, with limited deflection. Thus, moveable knuckle visual location system 190 allows for a more rigid, lighter hammer assembly, thereby improving piano action response.

The moveable knuckle visual location system 190 further allows for custom configuration of a specifically dimensioned hammer assembly to fit any brand of grand piano. Intricate shape 245 further comprises at least one pointer 194, preferably 2, which snuggly fits into one of several notches 192 within intricate shape 196. Pointers 194 are located on the bottom of moveable knuckle 240. Notches 192 are located on the bottom of tubular lever interface 20. Moveable knuckle 240 can be located onto tubular lever interface 20 at any one of multiple distinct locations along a range that runs parallel to the length of the hammer shank 30 and the length of tubular lever interface 20. Thus, a moveable knuckle 240 can be affixed to a tubular lever interface 20 at the specific location to yield the exact tubular lever interface center-to-center dimension 150 required by a particular brand of grand piano to allow for proper piano action function.

The moveable knuckle visual location system 190 further comprises a visual scale to allow a piano technician to quickly attach a moveable knuckle 240 to a tubular lever interface 20 at the required location. This is accomplished by a location mark 248 on each side of moveable knuckle 240 and graduation marks 198 located on each side of a tubular lever interface 20. Location marks 248 are located on the moveable knuckle center-line 246.

Taking into account that most grand piano actions 15 require a tubular lever interface center-to-center dimension 150 of 15-19 millimeters, the moveable knuckle visual location system 190 is designed to designate an attachment location within this range. Thus, there are a sufficient number of notches 192 that span a range of at least 4 mm along the length of the tubular lever interface 20. In the best mode, notches 192 are sized approximately 1.0 mm in width and pointer 194 is also sized at approximately 1.0 mm in width. The pointer and notches are sized so that the pointer snugly fits inside of a notch, thus the pointer may be slightly less than 1 mm wide and the notches may be slightly more that 1 mm wide.

Figure 7:
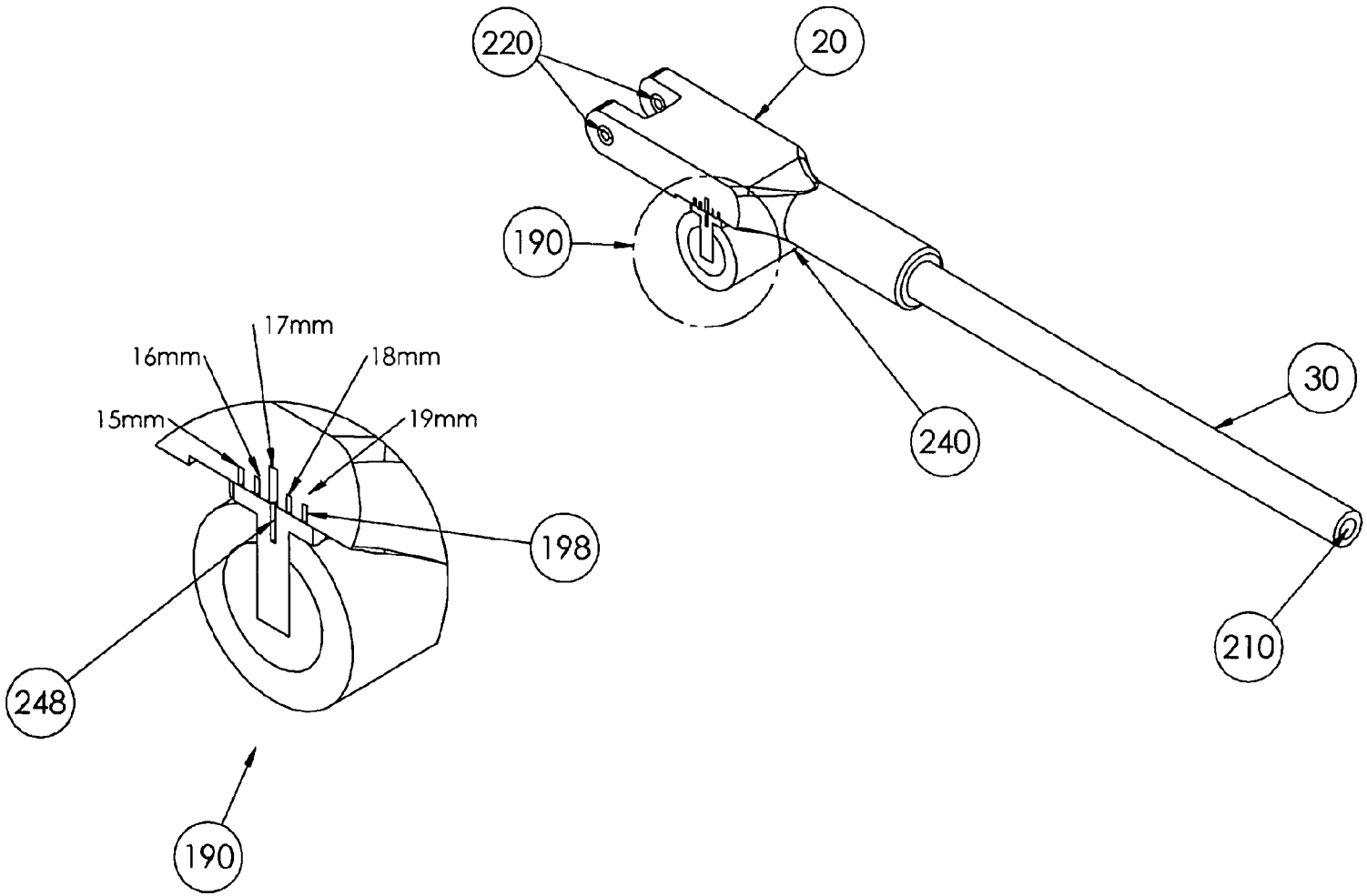
FIG. 7 is a perspective view of a tubular lever interface with attached moveable knuckle and hammer shank including blow-up view of moveable knuckle visual location system.
Figure 8:
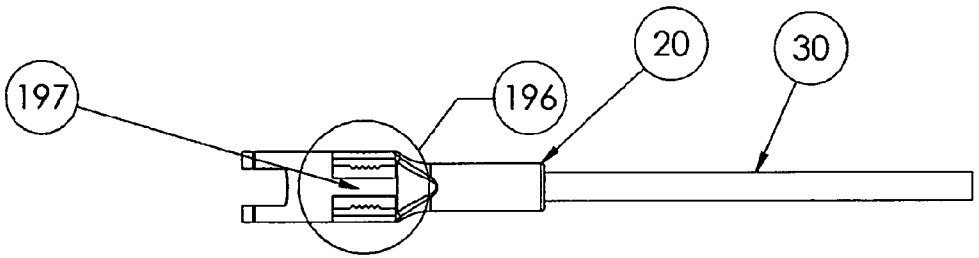
FIG. 8 is a bottom view of a tubular lever interface with attached hammer shank.
Figure 10:
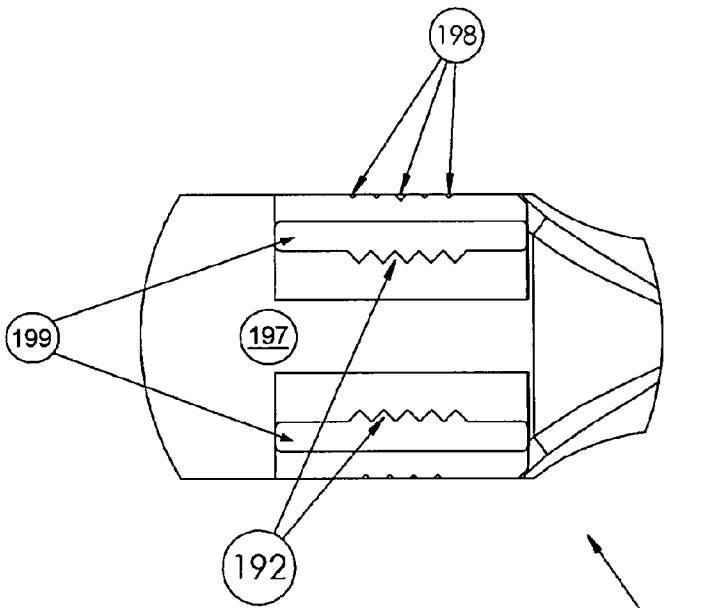
FIG. 10 is a blow-up view of intricate shape on bottom of tubular lever interface.
Figure 9:
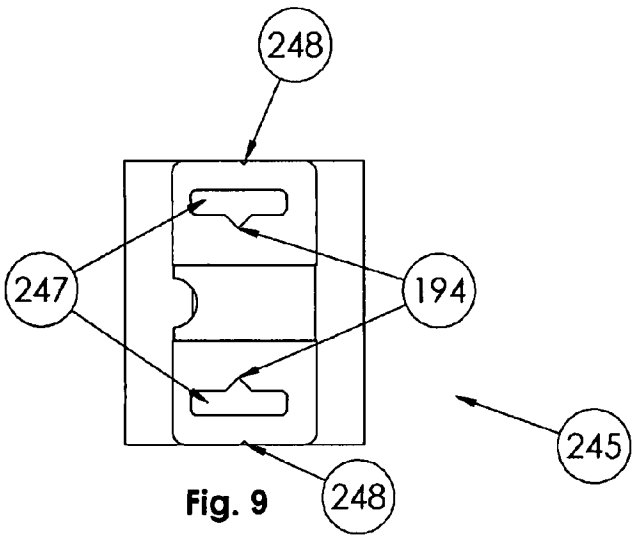
FIG. 9 is a blow-up view of intricate shape on bottom of moveable knuckle.
Figure 11:
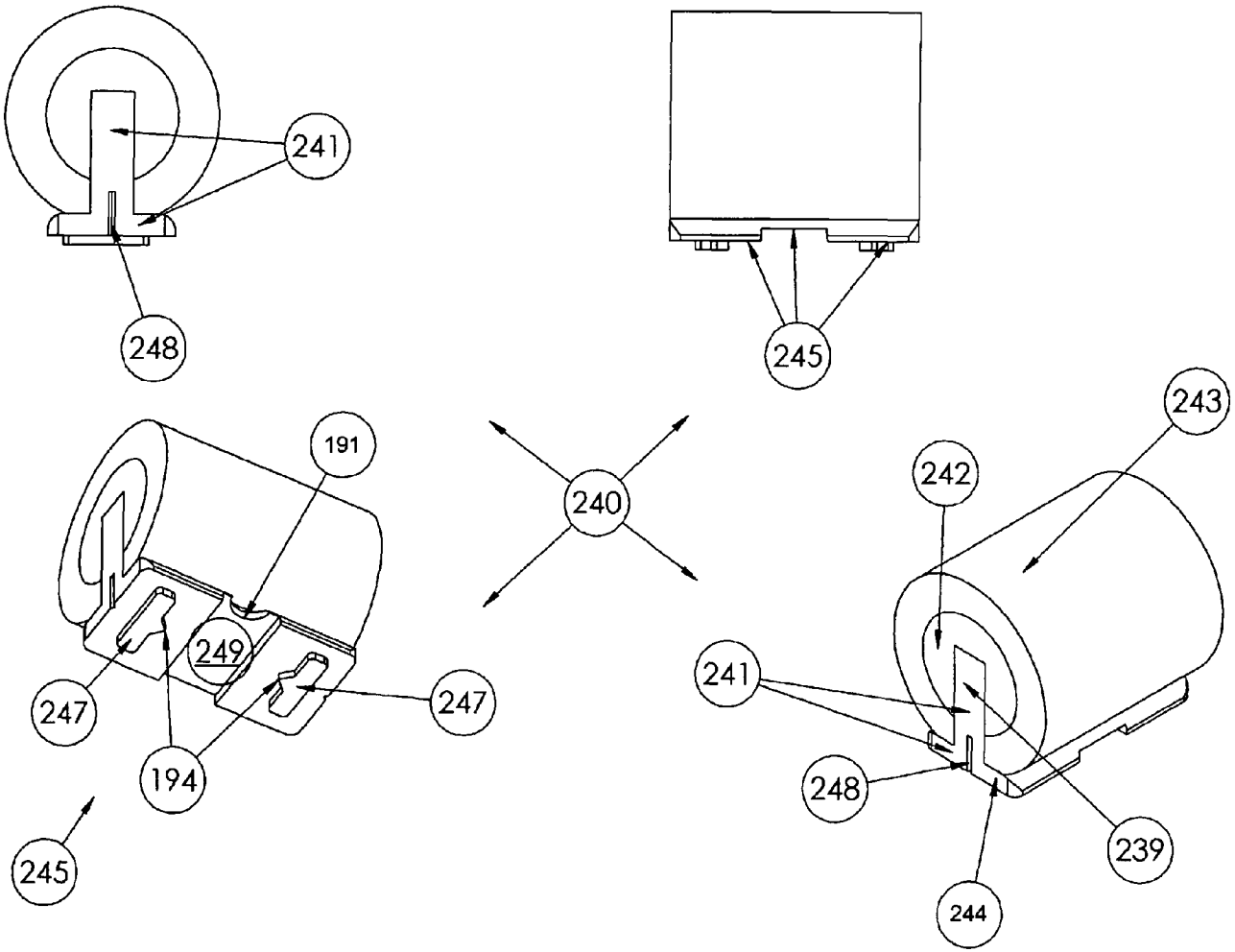
FIG. 11 depicts several views of a moveable knuckle. Top left is a side view. Top right is a front view. Bottom left is a perspective view of moveable knuckle from bottom angle. Bottom right is a perspective view of moveable knuckle from top angle.

Marks 248 and 198 are "positionally" related to notches 192 and pointers 194 on a continuous basis, i.e. the distance between a mark 248 and pointer 194 is constant and the distance between marks 198 and their corresponding notches 192 is constant, as measured in one dimension along the long axis of the hammer assembly. Thus, when members 20 and 30 are attached to yield a tubular lever interface center-to-center dimension 150 of 17 mm, for instance, the visual moveable knuckle visual location system 190 correspondingly designates 17 mm. See FIG. 7. The best mode allows for 9 distinct positions from 15-19 with 0.5 mm increments. Therefore, a hammer assembly can easily be assembled with the required center-to-center dimension 150 to yield proper functioning of the piano action in a relatively short time period.

In the best mode, pointer 194 is off-set from center line 246 by 0.25 mm. This allows 0.5 mm increments by rotating the knuckle 180 degrees in relation to the tubular lever interface 20. For instance, starting at the 17 mm position, the location marks 248 align with the center graduation mark 198. To relocate moveable knuckle 240 to the 17.5 mm position, the knuckle 240 is rotated 180 degrees and re-attached to tubular lever interface 20 with reversed pointers 194 nesting in the same notches 192 as before in the 17 mm position. To then relocate to the 18 mm position, the knuckle 240 is again rotated and attached to the tubular lever interface 20 with pointers 194 nesting in the adjacent set of notches (toward the hammer) to those used in the 17 mm position. To allow the technician to know which way the knuckle should be rotated, there is a half round shape 191 positioned on one edge of the knuckle spline 241. When the half round 191 is pointed away from the center-of-rotation, knuckle positioning occurs on integer-millimeter designations and vice versa for half-millimeter designations. In this fashion, moveable knuckle 240 may be positioned at 15, 15.5, 16, 16.5, 17, 17.5, 18, 18.5, and 19 mm tubular lever interface center-to-center distances 150 while notches and pointers are 1 mm in width.

Best mode tubular lever interfaces 20 are made of composite material or plastic material. Composite is defined as an engineered material made from two or more constituent materials with significantly different physical or chemical properties and which remain separate and distinct on a macroscopic level within the finished structure. Composites and plastics yield advantages over wood, relating to efficiency of manufacture and maintenance, as discussed in the back ground of invention section. Composite and plastic tubular lever interfaces 20 can be more efficiently produced at a greatly improved accuracy and precision over their wood counterparts. This accuracy is especially demanded by the moveable knuckle visual location system 190 with small notches, pointers, and graduation marks that must yield accuracy within about 0.05 mm. Additionally, composite material with filler additives provide the capability for increased stiffness of the parts, which is extremely important to the responsiveness and touch weight requirement of any piano. Best mode tubular lever interfaces 20 are made of 6/6 Nylon with 50% long glass fiber. This material is currently considered the best mode because it yields the best combination of performance and cost. As the cost of composites or plastics with different filler materials fluctuates with economic trends, a new best mode material will likely be chosen.

Best mode hammer shanks 30 include a range of three types of tubes to retrofit one grand piano. The strongest shanks 30 are required in the bass end of the piano 45 because hammers 40 are heaviest at this end. Very strong shanks 30 are required to minimize deflection in the bass keys. In the treble end, hammers 40 are much lighter, thus stronger and heavier shanks 30 are not required. The weight of a heavy shank 30 in treble keys is undesirable because the additional weight in turn adds unnecessary leverage to the key 10 and thereby increases touch weight of the key 10. In this instance, the shank 30 itself would act to dampen the motion of the hammer 40. Thus, a lighter, less rigid shank 30 may be used in the treble end of the piano 45 as compared to the bass end. Because the bass shanks and the treble shanks are so different in mass, we utilize a transitional shank that has the same outside diameter as the bass but with a thinner wall thickness so as to bring the overall shank weight closer to that of the treble. The best mode comprises three different composite shanks 30 of tapering mass resulting in a powerful piano while also smooth in its transitions from key to key. Taking into account that shanks 30 with different outside diameters require different tubular lever interfaces 20 with corresponding diameter deep socket holes 200, one mode of this invention includes the use three different shanks 30 with the same outside diameter to retrofit one grand piano using one style of tubular lever interface 20.

What is claimed is:

1. A hammer assembly for a grand piano comprising:

a hammer, capable of striking a piano wire to produce a musical piano tone;

a hammer shank (30), comprising an oblong shaped member with a first end and a second end;

a moveable knuckle (240), comprising a cylindrically shaped member with a center line (246) that is the vertical bisection of the circular cross-section of said moveable knuckle; and a tubular lever interface (20), comprising a hinge lever fixture with a hinge end, an oblong rigid body, a fixture end, a bottom, a top, a front, and a back, further comprising, a deep socket (200) at said fixture end, a set of two hinge pin attachment holes (220) at said hinge end, a void area (230) at said hinge end, and a moveable knuckle visual location system (190) at said bottom, said front, or said back, wherein, said two hinge pin attachment holes are each coaxial and concentric with a hammer shank center-of-rotation (185) axis and each function to accept one end of a hinge pin, said void area is located between said two hinge pin attachment holes and functions to allow clearance for the male hinge portion of a shank flange during rotation of said tubular lever interface, said hammer is permanently affixed to said first end of said hammer shank, said tubular lever interface is permanently affixed to said second end of said hammer shank by insertion into said deep socket, and said moveable knuckle is permanently affixed to said bottom of said tubular lever interface, adjacent to said moveable knuckle visual location system.

2. A hammer assembly for a grand piano as in claim 1 wherein said deep socket has sufficient depth to allow for said hammer shank to be inserted and affixed inside of said deep socket to a depth that surpasses the position of said knuckle center line (246) to provide a lever and fulcrum arrangement wherein said hammer shank (30) functions as a lever to pry upwards and around the hammer shank center-of-rotation (185), which functions as a fulcrum.

3. A hammer assembly for a grand piano as in claim 1 wherein said moveable knuckle further comprises: a spline (241); a resilient core (242); a synthetic buckskin wear surface (243), and a moveable knuckle visual location system (190).

4. A hammer assembly for a grand piano as in claim 2 wherein said spline further comprises: an upright rectangular portion (239) and a wide base portion (244).

5. A hammer assembly for a grand piano as in claim 2 wherein said moveable knuckle can be located on and affixed to said tubular lever interface at any one of multiple distinct locations along a linear range that runs parallel to the length of said hammer shank and the length of said tubular lever interface to yield said hammer assembly with a specific tubular interface lever center-to-center dimension (150) of 14-20 millimeters with 0.5 millimeter increments between said multiple distinct locations.

6. A hammer assembly for a grand piano as in claim 2 wherein said moveable knuckle visual location system further comprises: a set of graduation marks (198) on a side of said tubular lever interface and at least one location mark (248) on a side of said moveable knuckle wherein said tubular lever interface and said moveable knuckle can be connected to yield said hammer assembly with a specific tubular lever interface center-to-center dimension (150) of 14-20 millimeters wherein said marks visually indicate the specific tubular lever interface center-to-center dimension (150) by designation of the alignment of one of said set of graduation marks with one said at least one location mark.

7. A hammer assembly for a grand piano as in claim 2 wherein said moveable knuckle visual location system further comprises: at least one pointer (194) on the bottom surface of said moveable knuckle and a set of several notches (192) on the bottom surface of said tubular lever interface, wherein said at least one pointer and each notch of said set of several notches are sized to fit snuggly together, each having essentially the same width.

8. A hammer assembly for a grand piano as in claim 2 wherein said hammer shank, said tubular lever interface, and said spline are made of plastic or composite material.

9. A hammer assembly for grand piano as in claim 6 wherein said hammer shank is of hollow cylindrical form.

10. A hammer assembly for a grand piano as in claim 2 wherein said moveable knuckle visual location system further comprises a knuckle intricate shape (245) on the bottom surface of said moveable knuckle, which comprises: at least one recess area (249) and at least one protrusion area (247).

11. A hammer assembly for a grand piano as in claim 8 wherein said knuckle intricate shape further comprises: at least one pointer (194), which fits snuggly into one of a set of several notches (192) within a tubular lever interface intricate shape (196) on the bottom surface of said tubular lever interface.

12. A hammer assembly for a grand piano as in claim 9 wherein said tubular lever interface intricate shape further comprises: at least one protrusion area (197), which is essentially the inverse shape of said at least one recess area on moveable knuckle (249), and at least one recess area (199), which is essentially the inverse shape of said at least one protrusion area on moveable knuckle (247).

13. A hammer assembly for a grand piano as in any of the preceding claims wherein said hammer shank and said tubular lever interface are made of plastic with glass fiber, carbon fiber, Kevlar fiber, or ceramic filler material.

14. A tubular lever interface for a grand piano as in claim 11 that is made of Nylon plastic with 40-60% glass fiber filler material.

15. A method to assemble a hammer assembly for a grand piano as in claim 11 comprising the steps of: affixing the first end of said hammer shank to said tubular lever interface at said deep socket; affixing said moveable knuckle to said tubular lever interface at said moveable knuckle location system; and affixing the second end of said hammer shank to said hammer.

* * * * *